US011499393B2

(12) United States Patent
Bilen et al.

(10) Patent No.: US 11,499,393 B2
(45) Date of Patent: Nov. 15, 2022

(54) WIPER PLUG SYSTEM WITH ANTI-ROTATION FEATURE

(71) Applicants: Juan Miguel Bilen, The Woodlands, TX (US); Dennis Jiral, Katy, TX (US); Alexander Schultz, Montgomery, TX (US)

(72) Inventors: Juan Miguel Bilen, The Woodlands, TX (US); Dennis Jiral, Katy, TX (US); Alexander Schultz, Montgomery, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 46 days.

(21) Appl. No.: 17/014,077

(22) Filed: Sep. 8, 2020

(65) Prior Publication Data

US 2022/0074281 A1 Mar. 10, 2022

(51) Int. Cl.
*E21B 33/16* (2006.01)

(52) U.S. Cl.
CPC ..... *E21B 33/16* (2013.01)

(58) Field of Classification Search
CPC ..... E21B 33/124; E21B 33/126; E21B 33/14; E21B 33/146; E21B 33/16; E21B 33/165; E21B 33/167
See application file for complete search history.

(56) References Cited

U.S. PATENT DOCUMENTS

| | | | | |
|---|---|---|---|---|
| 42,592 | A | 5/1864 | Morse | |
| 6,945,326 | B2 | 9/2005 | Mikolajczyk | |
| 9,303,482 | B2 * | 4/2016 | Hall | E21B 33/16 |
| 10,077,614 | B2 | 9/2018 | Telfer | |
| 10,533,392 | B2 | 1/2020 | Walton et al. | |
| 2004/0016538 | A1 | 1/2004 | Butterfield et al. | |
| 2005/0103492 | A1 * | 5/2005 | Szarka | E21B 33/16 166/381 |
| 2008/0006403 | A1 | 1/2008 | Benzie et al. | |

(Continued)

FOREIGN PATENT DOCUMENTS

CN 204327042 U 5/2015

OTHER PUBLICATIONS

Collins Dictionary—Morse Taper—Accessed 2022 https://www.collinsdictionary.com/dictionary/english/morse-taper (Year: 2022).*

(Continued)

*Primary Examiner* — David Carroll
(74) *Attorney, Agent, or Firm* — Cantor Colburn LLP

(57) ABSTRACT

A sub having an anti-rotation feature for a resource exploration and recovery system includes a tubular having an outer surface and an inner surface defining a flow bore. A sleeve is slideably disposed in the flow bore between a first position and a second position. The sleeve includes an inner surface portion having a taper. A dart including an end portion is disposed in the sleeve. The dart is configured to shift the sleeve between the first position and the second position when exposed to a selected pressure in the flowbore. The end portion includes a tapered section. The tapered section mating with the taper formed in the inner surface to rotatably lock the plug to the inner surface of the sleeve.

12 Claims, 5 Drawing Sheets

(56) References Cited

U.S. PATENT DOCUMENTS

| | | | | |
|---|---|---|---|---|
| 2010/0294503 | A1* | 11/2010 | Laurel | E21B 33/05 166/153 |
| 2011/0284240 | A1* | 11/2011 | Chen | E21B 34/14 166/334.1 |
| 2017/0370178 | A1 | 12/2017 | Budler | |

OTHER PUBLICATIONS

International Search Report and Written Opinion for International Application No. PCT/US2021/071350; International Filing Date Sep. 2, 2021; Report dated Dec. 1, 2021 (pp. 1-8).

* cited by examiner

WIPER PLUG SYSTEM WITH ANTI-ROTATION FEATURE

BACKGROUND

In the resource recovery industry, a liner wiper plug system is introduced into a tubular to displace and separate fluids. The liner wiper plug system typically includes any combination of liner wiper plugs and darts. For example, to begin cementing operations, a dart is placed in a drill pipe to separate existing drill fluid from cement. The cement is used to forces the dart and any fluid in front of the dart to a bottom of a running tool that supports a liner. The dart eventually lands in a liner wiper plug.

This combination of dart and plug travel to the bottom of a casing to displace all fluid until the liner wiper lands at a determined location. The cement it allowed to bypass by hydraulic or mechanical means. The dart typically includes one or more wiper members that engage an inner surface of the work string. The wiper members remove cement from the inner surface when the liner wiper plug is pumped downhole.

After forcing the cement into the annulus, a second dart is deployed from surface and is displaced, typically by drill fluid, until it engages with a second liner wiper plug at the bottom of the running tool. The cement is forced upwardly filling an annulus that exists between the liner and a surface of the wellbore. The second liner wiper plug then lands on the first liner wiper plug to create a barrier while the cement hardens. At the completion of this operation, a drilling operation is conducted to remove the liner wiper plug system prior to proceeding to the next operation in the drilling program.

On occasion, the dart and liner wiper plug may not be fixed in place at the bottom of the tubular. That is, often times, the dart may rotate relative to the first plug. The rotation of the dart relative to the plug may work against drilling forces and thus complicate the drilling operation. Delays in removing the liner wiper plug system lead to costly production delays and may also require expensive well intervention measures to remove the liner wiper plug system. Accordingly, the industry would welcome a system that eliminates the potential for components of the liner wiper plug system to rotate relative to one another.

SUMMARY

Disclosed is a sub having an anti-rotation feature for a resource exploration and recovery system including a tubular having an outer surface and an inner surface defining a flow bore. A sleeve is slideably disposed in the flow bore between a first position and a second position. The sleeve includes an inner surface portion having a taper. A dart including an end portion is disposed in the sleeve. The dart is configured to shift the sleeve between the first position and the second position when exposed to a selected pressure in the flowbore. The end portion includes a tapered section. The tapered section mating with the taper formed in the inner surface to rotatably lock the plug to the inner surface of the sleeve.

Also disclosed is a resource exploration and recovery system including a first system arranged on a surface of a formation, and a second system extending from the first system into the formation. The second system includes a casing tubular and a work string extending into the casing tubular. The work string includes a sub including a tubular having an outer surface and an inner surface defining a flow bore. A sleeve is slideably disposed in the flow bore between a first position and a second position. The sleeve includes an inner surface portion having a taper. A dart including an end portion is disposed in the sleeve. The dart is configured to shift the sleeve between the first position and the second position when exposed to a selected pressure in the flowbore. The end portion includes a tapered section. The tapered section mating with the taper formed in the inner surface to rotatably lock the plug to the inner surface of the sleeve.

Further disclosed is a method of performing a cementing operation including introducing a flow of cement into a work string, passing the flow of cement through an opening in a cementing sub attached to the work string into a wellbore, pumping the cement between a casing and an annular wall of the wellbore, landing a dart in the cementing sub to close the opening, rotationally locking the dart to the cementing sub, and drilling through the wiper dart.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
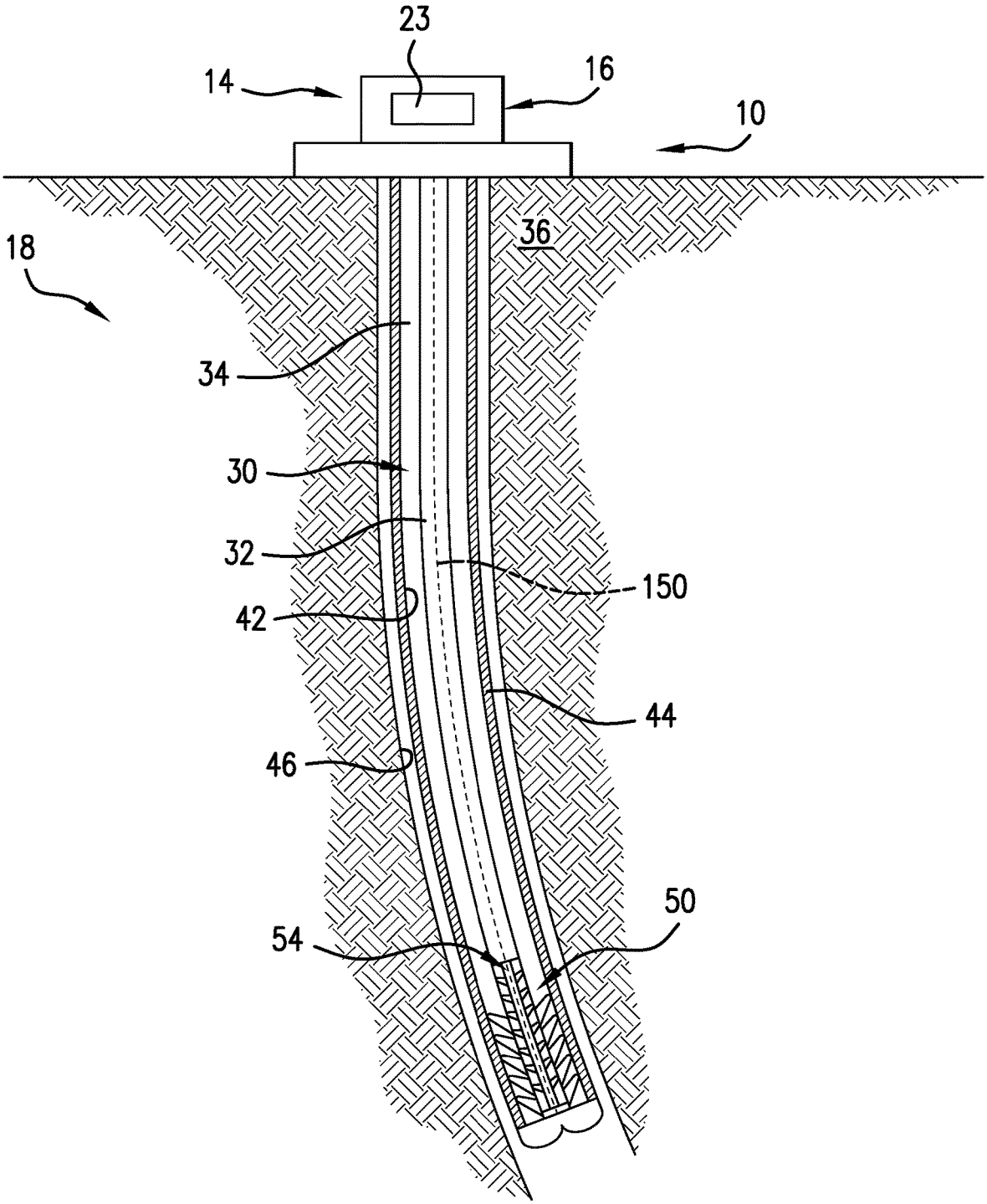
FIG. 1 depicts a resource exploration and recovery system illustrating a cementing sub including a wiper plug system having an anti-rotation feature, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a subsurface or downhole system (not separately labeled).

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 includes a work string 30 which may be formed from one or a system of interconnected tubulars such as indicated at 32. Work string 30 extends into a wellbore 34 formed in a formation 36.

Wellbore 34 includes an annular wall 42 which may be defined by a casing tubular 44 that may be spaced from a surface 46 of formation 36.

Work string 30 may take the form of a cementing system 50 that is operable to initiate and perform a cementing operation. That is, cementing system 50 may be employed to introduce an amount of cement (not shown) between casing tubular 44 and surface 46 of formation 36. As will be detailed herein, cementing system 50 supports a liner wiper plug system 54 having an anti-rotation feature. That is, liner wiper plug system 54 locks into place in cementing system 50 so as to facilitate drill out at the completion of the cementing operation. At this point, it should be understood that while described as being employed in connection with a cementing system, exemplary embodiments described herein may be employed in other downhole applications that would benefit from rotationally fixed darts, plugs or other components.

Figure 2:
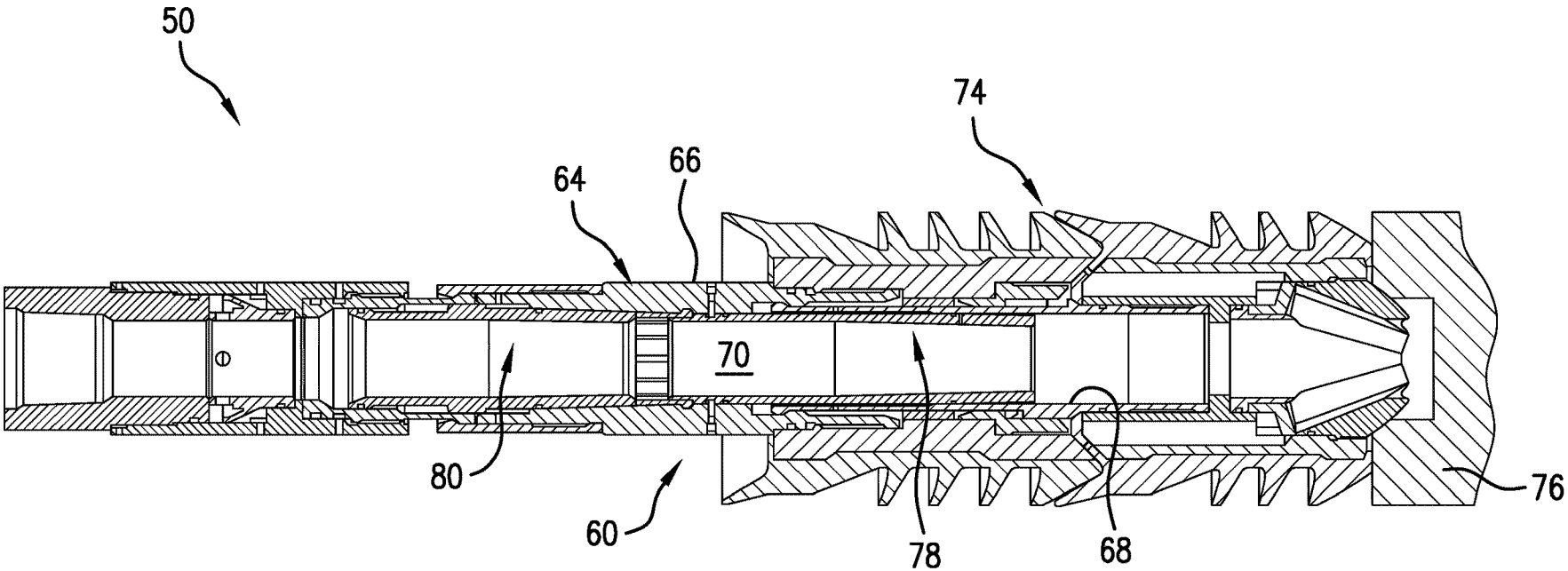
FIG. 2 depicts the cementing sub of FIG. 1 landed in a tubular.

Referring to FIG. 2, cementing system 50 includes a sub 60 including a tubular 64 having an outer surface 66 and an inner surface 68 that defines a flow bore 70. Sub 60 includes one or more flexible seal elements 74 that seal against an inner surface (not separately labeled) of casing tubular 44. Sub 60 may land on, and engage with a float shoe 76. Sub 60 may include features (not separately labeled) that engage with corresponding features (also not separately labeled) in float shoe 76 to form a seal. In an embodiment, sub 60 includes a first sleeve 78 arranged in flow bore 70 and a second sleeve 80 arranged in flow bore 70 uphole of first sleeve 78. First sleeve 78 is moveably disposed in flow bore 70 and shiftable between a first position (FIGS. 2 and 3) and a second position (FIG. 4) to facilitate a cementing operation. Second sleeve 80 may be fixed relative to flow bore 70.

Figure 3:
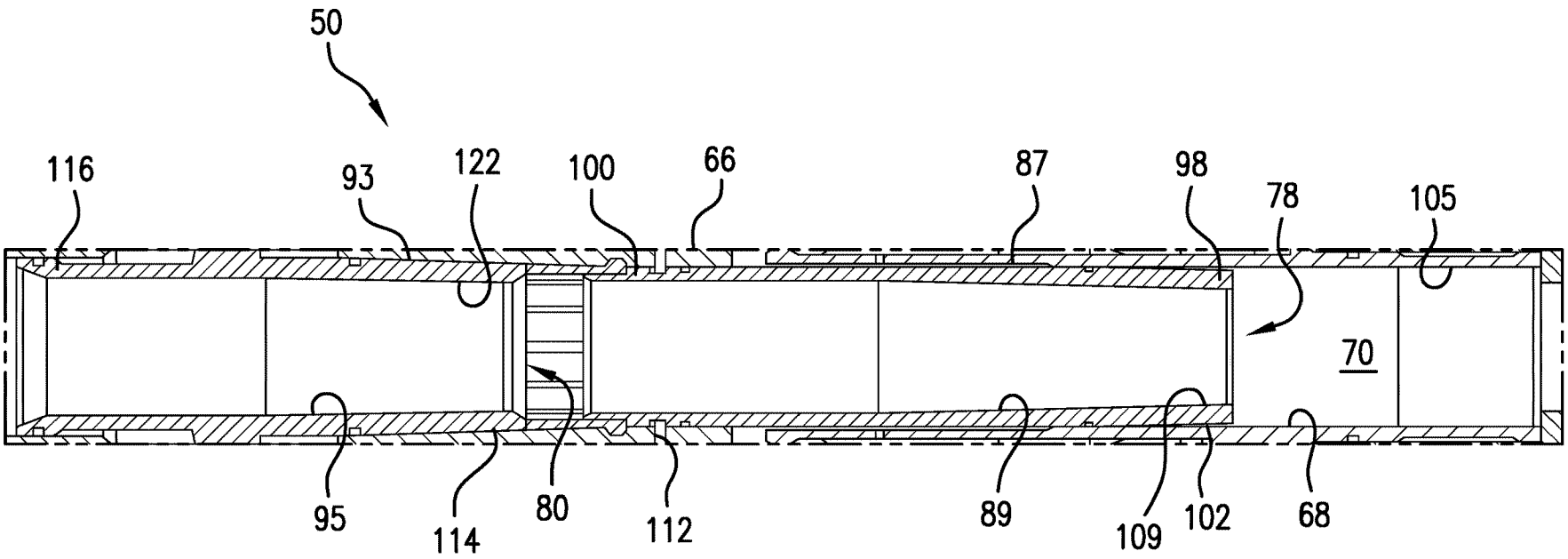
FIG. 3 depicts first and second sliding sleeves of the cementing sub in an unlocked position, in accordance with an aspect of an exemplary embodiment.
Figure 4:
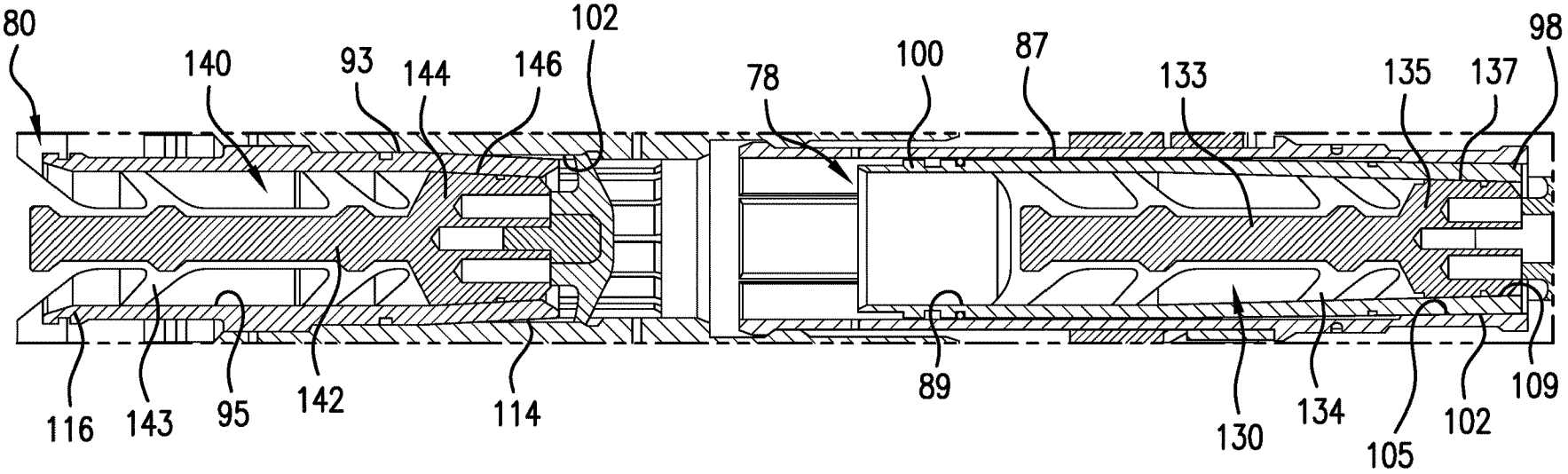
FIG. 4 depicts the first and second darts received in corresponding ones of the first and second sliding sleeves with the first and second sliding sleeves being shifted to an unlocked position, in accordance with an aspect of an exemplary embodiment.

As shown in FIG. 3, first sleeve 78 includes a first outer surface portion 87 and a first inner surface portion 89. Second sleeve 80 includes a second outer surface portion 93 and a second inner surface portion 95. First sleeve 78 includes a first end portion 98 and a second end portion 100. First outer surface portion 87 includes a tapered segment 102 at first end portion 98. Tapered segment 102 may mate with a taper 105 on inner surface 68 when first sleeve 78 is moved to the second position. First inner surface 89 may include a taper 109 at first end portion 98. At this point, it Should be understood that, in an exemplary aspect, tapered segment 102, and taper 109 represent a change in diameter of first sleeve 78 relative to a longitudinal axis of tubular 64, while taper 105 represents a change in internal diameter of tubular 54 relative to the longitudinal axis.

In an embodiment, tapered segment 102, and taper 105 may take the form of a shallow angle taper including an angle of between about 1° and about 7°. In another embodiment, tapered segment 102 and taper 105 may have an angle of between about 1° and about 7°. Tapered segment 102 and taper 105 may take the form of, for example, a Morse taper, to rotationally lock sleeve 78 relative to tubular 64 and/or create a seal. First sleeve 78 is fixed in flow bore 70 by a shear element 112. In a manner similar to that discussed herein, second sleeve 80 includes a first end portion 114 and a second end portion 116. Second inner surface portion 95 includes a taper 122 at first end portion 114. At this point, it should be understood that, in an exemplary aspect, taper 122 represents a change in diameter of second sleeve 80 relative to a longitudinal axis of tubular 64

In an embodiment, a first dart 130 is introduced into work string 30 and passed to first sleeve 78. Pressure is applied to first dart 130 causing shear element 112 to fail allowing first sleeve 78 to shift from the first position to the second position. First dart 130 includes a body 133 that supports a number of wiper elements 134 and a landing end portion 135. Landing end portion 135 includes a tapered section 137 that mates with taper 109 on first inner surface portion 89. At this point, it should be understood that, in an exemplary aspect, tapered section 137 represents a change in diameter of landing end portion 135 along a longitudinal axis of body 133.

In a manner similar to that discussed above, tapered section 137 and taper 109 come together or define mating surfaces that form a Morse taper which rotationally fixes and/or seals first dart 130 in first sleeve 78. In an embodiment, tapered section 137 and taper 109 include shallow angle taper having an angle of between about 1° and about 7°. In another embodiment, tapered section 137 and taper 109 may have an angle of between about 3° and about 7°.

After landing first dart 130, a cementing operation may begin. Cement is introduced into work string 30, passed through sub 60 and forced into an area between casing tubular 44 and surface 46 of formation 36. Once the cementing operation is complete, a second dart or pump down plug 140 is introduced into work string 30 and pumped downhole. Second dart 140 includes a body 142 supporting a plurality of wiper elements 143 and a landing end portion 144.

Landing end portion 144 includes a tapered section 146 that mates with taper 122 on second inner surface portion 95. In a manner similar to that discussed above, tapered section 146 and taper 122 come together to form a Morse taper that rotationally fixes and/or seals second dart 140 in second sleeve 80. In an embodiment, tapered section 146 and taper 122 include shallow angle taper having an angle of between about 1° and about 7°. In another embodiment, tapered section 146 and taper 122 may have an angle of between about 3° and about 7°. At this point, it should be understood that, in an exemplary aspect, tapered section 146 represents a change in diameter of landing end portion 144 along a longitudinal axis of body 142.

Second dart 140 is pumped downhole such that wiper elements 143 clean internal surfaces of work string 30 and force any remaining cement out into wellbore 34. Second dart 140 is landed in locked into second sleeve 80. After landing second dart 140, a drill out operation may commence. A drill string, such as indicated at 150 in FIG. 1 may be introduced into work string 30. Drill string 150 may be employed to drill out first and second plugs or darts 130 and 140 as well as other components, such as, for example, first and second sleeves 78 and 80 in sub 60.

Figure 5:
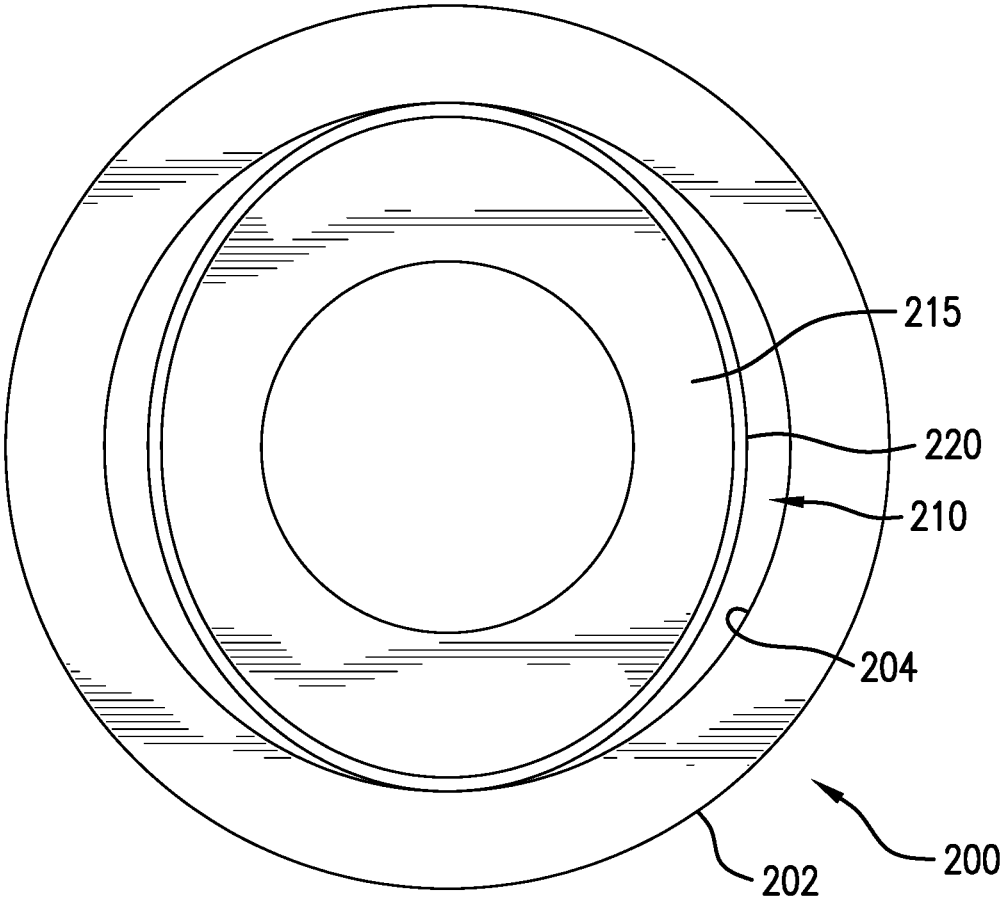
FIG. 5 depicts an axial end view of a sliding sleeve and dart, in accordance with another aspect of an exemplary embodiment.

In another embodiment shown in FIG. 5, a sleeve 200 may include an outer surface 202 and an inner surface 204. Inner surface 204 may have a non-circular geometry. That is, inner surface 204 may include a taper that represents a change in diameter relative to a radius of sleeve 200. A dart or plug 210 may include a landing end portion 215 having an outer surface 220. Outer surface 220 may include a taper that represents a change in diameter relative to a radius of landing end portion 215. Thus, it should be understood that the term taper, in accordance with exemplary embodiments encompasses both axial and radial changes in diameter.

At this point it should be understood that the exemplary embodiments enhance the efficacy of drilling out liner wiper plugs. That is, by locking the liner wiper plugs to sleeves and the sleeves to the sub, drilling may proceed without experiencing spin out. That is, the darts and/or sleeves are fixed and thus will not spin when acted on by a drill bit. Thus, drilling may proceed without delay or the need for additional interventions steps thereby reducing drill time, effort and enhancing production efficiency.

Set forth below are some embodiments of the foregoing disclosure:

Embodiment 1. A sub having an anti-rotation feature for a resource exploration and recovery system comprising: a tubular including an outer surface and an inner surface defining a flow bore; a sleeve slideably disposed in the flow bore between a first position and a second position, the sleeve including an inner surface portion having a taper; and a dart including an end portion disposed in the sleeve, the dart being configured to shift the sleeve between the first position and the second position when exposed to a selected pressure in the flowbore, the end portion including a tapered section, the tapered section mating with the taper formed in the inner surface to rotatably lock the plug to the inner surface of the sleeve.

Embodiment 2. The sub according to any prior embodiment, wherein the taper is formed with an angle of between about 1° and about 7°.

Embodiment 3. The sub according to any prior embodiment, wherein the taper defines a Morse taper.

Embodiment 4. The sub according to any prior embodiment, further comprising: a plurality of flexible seal elements arranged on the outer surface.

Embodiment 5. The sub according to any prior embodiment, wherein the inner surface of the tubular includes a taper having an angle that is configured to engage with and rotationally lock the sleeve.

Embodiment 6. The sub according to any prior embodiment, wherein the sleeve includes an outer surface portion having a tapered segment including an angle configured to mate with the taper in the inner surface of the tubular.

Embodiment 7. The sub according to any prior embodiment, wherein the angle of the tapered segment is substantially complimentary to the angle of the inner surface of the tubular.

Embodiment 8. A resource exploration and recovery system comprising: a first system arranged on a surface of a formation; a second system extending from the first system into the formation, the second system including a casing tubular and a work string extending into the casing tubular, the work string including a sub comprising: a tubular including an outer surface and an inner surface defining a flow bore; a sleeve slideably disposed in the flow bore between a first position and a second position, the sleeve including an inner surface portion having a taper; and a dart including an end portion disposed in the sleeve, the plug being configured to shift the sleeve between the first position and the second position when exposed to a selected pressure in the flowbore, the end portion including a tapered section, the tapered section mating with the taper formed in the inner surface to rotatably lock the plug to the inner surface of the sleeve.

Embodiment 9. The resource exploration and recovery system according to any prior embodiment, wherein the taper is formed with an angle of between about 1° and about 7°.

Embodiment 10. The resource exploration and recovery system according to any prior embodiment, wherein the taper defines a Morse taper.

Embodiment 11. The resource exploration and recovery system according to any prior embodiment, further comprising: a plurality of flexible seal elements arranged on the outer surface.

Embodiment 12. The resource exploration and recovery system according to any prior embodiment, wherein the inner surface of the tubular includes a taper having an angle that is configured to engage with and rotationally lock the sleeve.

Embodiment 13. The resource exploration and recovery system according to any prior embodiment, wherein the sleeve includes an outer surface portion having a tapered segment including an angle configured to mate with the taper in the inner surface of the tubular.

Embodiment 14. The resource exploration and recovery system according to any prior embodiment, wherein the angle of the tapered segment is substantially complimentary to the angle of the inner surface of the tubular.

Embodiment 15. A method of performing a cementing operation comprising: introducing a flow of cement into a work string; passing the flow of cement through an opening in a cementing sub attached to the work string into a wellbore; pumping the cement between a casing and an annular wall of the wellbore; landing a dart in the cementing sub to close the opening; rotationally locking the dart to the cementing sub; and drilling through the wiper dart.

Embodiment 16. The method according to any prior embodiment, wherein landing the dart includes guiding the dart into a sleeve slidably arranged in the cementing sub.

Embodiment 17. The method according to any prior embodiment, wherein rotationally locking the dart includes engaging an end portion of the dart with a tapered surface of the sleeve.

Embodiment 18. The method according to any prior embodiment, wherein engaging the end portion of the dart includes mating a tapered section of the end portion with a tapered surface of the sleeve.

Embodiment 19. The method according to any prior embodiment, wherein mating the tapered section with the tapered surface includes connecting the plug to the sleeve through a Morse taper.

Embodiment 20. The method according to any prior embodiment, further comprising: rotationally locking the sleeve relative to the cementing sub.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention is not limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A sub having an anti-rotation feature for a resource exploration and recovery system comprising:

a tubular including an outer surface and an inner surface defining a flow bore;

a sleeve slideably disposed in the flow bore between a first position and a second position, the sleeve including an inner surface portion having a taper; and a dart including an end portion disposed in the sleeve, the dart being configured to shift the sleeve between the first position and the second position when exposed to a selected pressure in the flowbore, the end portion including a tapered section, the tapered section mating with the taper formed in the inner surface to rotatably lock the plug to the inner surface of the sleeve; wherein the inner surface of the tubular includes a taper having an angle that is configured to engage with and rotationally lock the sleeve.

2. The sub according to claim 1, wherein the taper is formed with an angle of between about 1° and about 7°.

3. The sub according to claim 2, wherein the taper defines a Morse taper.

4. The sub according to claim 1, further comprising: a plurality of flexible seal elements arranged on the outer surface.

5. The sub according to claim 1, wherein the sleeve includes an outer surface portion having a tapered segment including an angle configured to mate with the taper in the inner surface of the tubular.

6. The sub according to claim 5, wherein the angle of the tapered segment is substantially complimentary to the angle of the inner surface of the tubular.

7. A resource exploration and recovery system comprising:

a first system arranged on a surface of a formation;

a second system extending from the first system into the formation, the second system including a casing tubular and a work string extending into the casing tubular, the work string including a sub comprising:

a tubular including an outer surface and an inner surface defining a flow bore;

a sleeve slideably disposed in the flow bore between a first position and a second position, the sleeve including an inner surface portion having a taper; and a dart including an end portion disposed in the sleeve, the plug dart being configured to shift the sleeve between the first position and the second position when exposed to a selected pressure in the flowbore, the end portion including a tapered section, the tapered section mating with the taper formed in the inner surface to rotatably lock the plug to the inner surface of the sleeve; wherein the inner surface of the tubular includes a taper having an angle that is configured to engage with and rotationally lock the sleeve.

8. The resource exploration and recovery system according to claim 7, wherein the taper is formed with an angle of between about 1° and about 7°.

9. The resource exploration and recovery system according to claim 8, wherein the taper defines a Morse taper.

10. The resource exploration and recovery system according to claim 7, further comprising: a plurality of flexible seal elements arranged on the outer surface.

11. The resource exploration and recovery system according to claim 8, wherein the sleeve includes an outer surface portion having a tapered segment including an angle configured to mate with the taper in the inner surface of the tubular.

12. The resource exploration and recovery system according to claim 11, wherein the angle of the tapered segment is substantially complimentary to the angle of the inner surface of the tubular.

* * * * *